United States Patent [19]

Rogers

[11] 3,960,367

[45] June 1, 1976

[54] FENCE WITH ADJUSTABLE VERTICAL PANELS

[75] Inventor: Alan Francis Rogers, Mississauga, Canada

[73] Assignee: Spacemaker (Products) Limited, Mississauga, Canada

[22] Filed: May 12, 1975

[21] Appl. No.: 576,871

[52] U.S. Cl. ..... 256/21; 256/65; 248/230

[51] Int. Cl.[2] ..... B21F 27/00

[58] Field of Search ..... 256/21, 22, 24, 59, 256/34, 65; 248/230, 221 ; 463/188

[56] References Cited

UNITED STATES PATENTS

| | | | |
|---|---|---|---|
| 2,687,283 | 8/1954 | Enchauser | 256/21 |
| 2,715,513 | 8/1955 | Kools | 256/21 |
| 3,067,985 | 12/1962 | Cusack | 256/22 |
| 3,343,811 | 9/1967 | Kusel et al. | 256/22 |

*Primary Examiner*—Paul R. Gilliam
*Assistant Examiner*—Doris L. Troutman

[57] ABSTRACT

An adjustable fence is provided comprising cylindrical fence posts, inverted channel-shaped rails running between the posts, and vertical panels attached to the rails. The rails are attached to the fence posts by collars which can be rotated on the posts and adjusted vertically and are pivotally connected to the rails to adapt to any terrain. The panels can be attached to either side of the rails by clamps which extend upwardly into the channels of the rails, and the clamps before tightening are adjustable longitudinally of the rails, allowing the panels to be adjusted to be vertical. The clamps are of narrower width than the panels so that if desired panels at one side of the rail can be arranged in edge to edge contact with one another.

10 Claims, 7 Drawing Figures

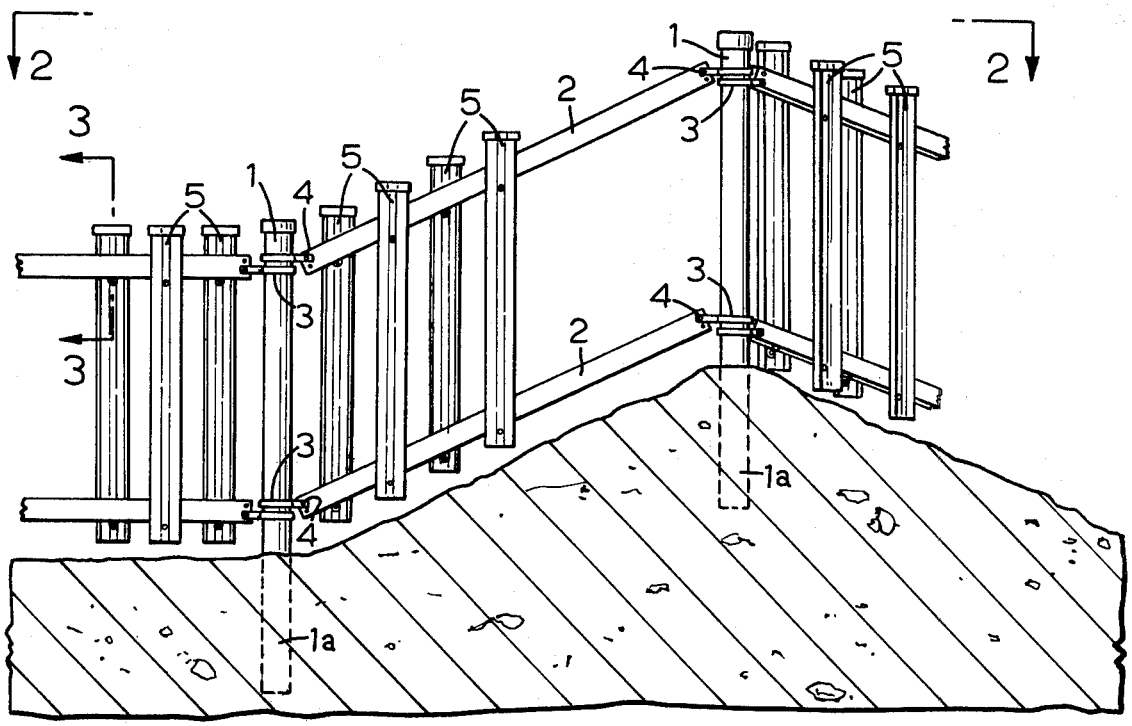
FIG. 1
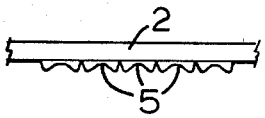
FIG. 6
FIG. 7
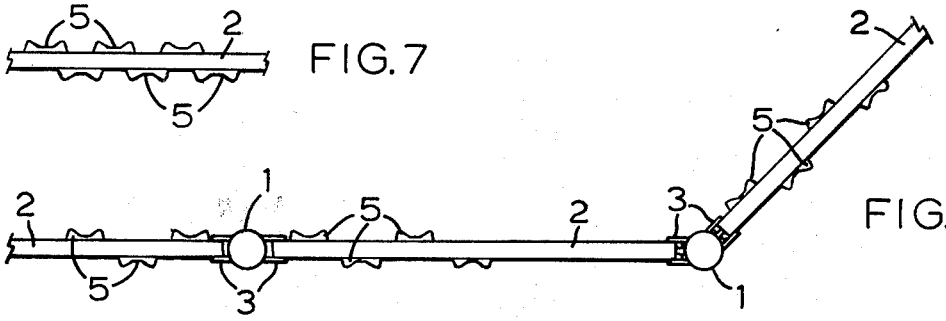
FIG. 2
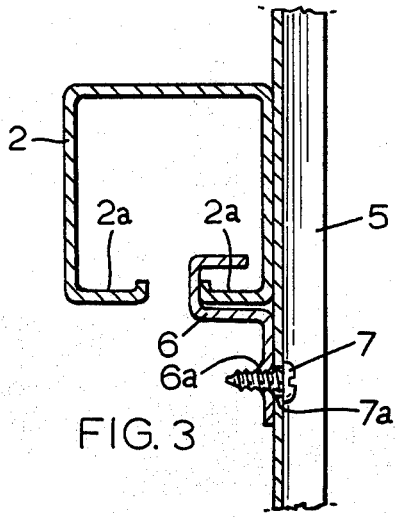
FIG. 3
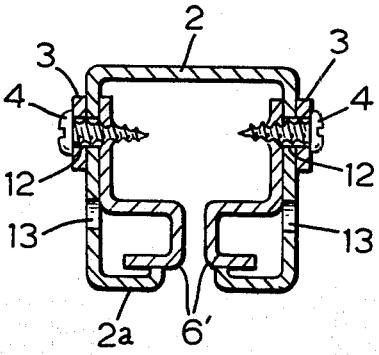
FIG. 5

FENCE WITH ADJUSTABLE VERTICAL PANELS

BACKGROUND OF THE INVENTION

1. Field of the Invention

This invention relates to fences having adjustable vertical panels.

2. Description of the Prior Art

Various adjustable fence structures have been proposed, but have suffered from complexity, or awkwardness of assembly, or lack of flexibility in installation or in changing style or arrangement after initial installation.

SUMMARY OF THE INVENTION

An adjustable fence is provided in which vertical panels can be secured to longitudinal rails by clamps which are adjustable longitudinally of the rails, the clamps being narrower than the panels so that if desired the panels can be arranged in edge to edge contact. The rails are inverted channels and the clamps extend upwardly into the channels. Panels can be connected to either or both sides of the rails. The rails are connected to cylindrical fence posts by collars which encircle the posts and are pivotally connected to the rails and can be adjusted on the posts both vertically and rotationally. The various connections are readily adjustable to adapt the fence to any terrain while allowing the panels to be arranged vertically.

BRIEF DESCRIPTION OF THE DRAWINGS

A preferred embodiment of the invention is illustrated in the accompanying drawings in which:

FIG. 1 is a side view of a fence installed on rough terrain;

FIG. 2 is a plan view of the fence taken along line 2—2 of FIG. 1;

FIG. 3 is an enlarged sectional view of part of the fence, taken along line 3—3 in FIG. 1;

FIG. 5 is a sectional view taken along line 5—5 in FIG. 4;

FIG. 6 is a plan view similar to FIG. 2 but showing a different panel arrangement; and FIG. 7 is another plan view showing another panel arrangement.

DESCRIPTION OF THE PREFERRED EMBODIMENT

Figure 4:
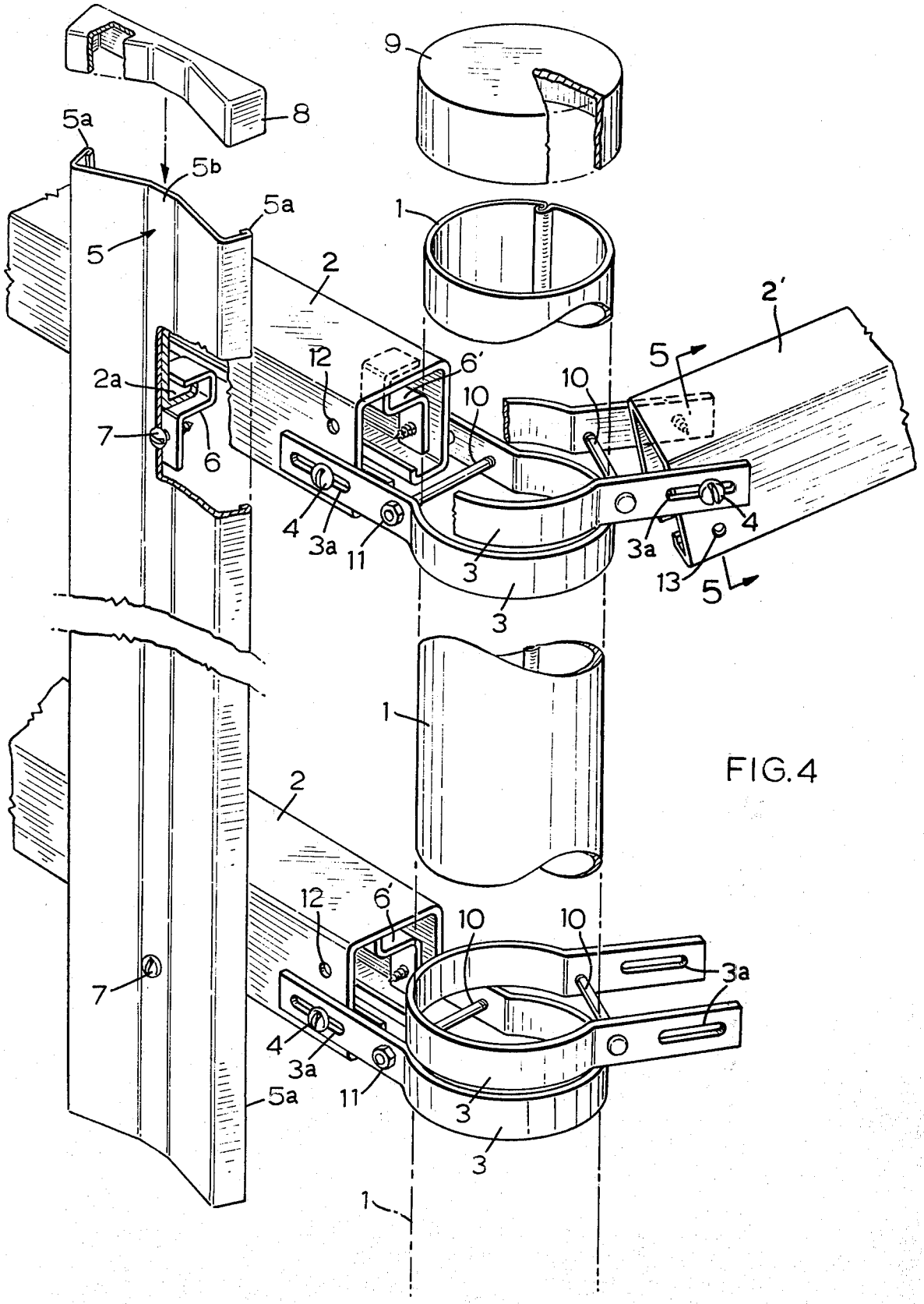
FIG. 4 is a partly broken away and partly exploded perspective view of a fence post junction.

Referring to FIG. 1, hollow cylindrical fence posts 1 are secured vertically in the ground as shown at 1*a*. Extending between the posts 1 are channel-shaped rails 2. The rails 2 are connected to the posts 1 by means of circular collars 3 about which the rails 2 can pivot vertically before screws 4 are tightened. This flexibility between the rails and the circular collars allows the fence to be erected on both uphill and downhill slopes without having to deform any parts of the fence. Vertical decorative panels 5 are secured to the rails 2 by clamps 6 (not visible in FIG. 1) and screws 7 as best seen in FIG. 3.

FIG. 2 is a plan view of the fence of FIG. 1. This view clearly shows how the collars 3 can be rotated on the posts 1 to allow corners to be formed in the fence at posts 1. As posts 1 and collars 3 are both circular, any desired angle can be formed at the corner. FIG. 3 is a sectional view along line 3—3 in FIG. 1. In FIG. 3, a panel 5 is shown secured to rail 2 by a clamp 6 which is in turn fastened to panel 5 by a screw 7. There is one hole 7*a* in panel 5 through which screw 7 is driven. As clamp 6 is not secured to the rail other than by the pressure exerted from the panel through screw 7, all that is required to move the panel is to loosen screw 7 and slide the panel to a new location. When erecting the fence on an incline, clamps 6 are inserted into rails 2 and the panels are arranged vertically before screws 7 are finally tightened.

In FIG. 4 a panel 5 is shown partly cut away to illustrate how a clamp 6 is secured to the panel by a screw 7, and how clamp 6 fits into rail 2. The clamps 6 are of spring metal and embrace inturned lips 2*a* of the channel-shaped rails 2, and can be slid therealong until the screws 7 are tightened. The screws deform the spring metal clamps at 6*a* (FIG. 3) and can pull the clamps tightly against the rail lips 2*a* and against the panels 5 to resist movement of the clamps and panels relative to the rails. The panels are preferably shaped as resilient metal pans having edges 5*a* (FIG. 4) that can bear against the rails 2, and the screws 7 pass through central portion 5*b* of the panels and as they are tightened the screws 7 draw the panel edges 5*a* tightly against the rails.

Panel cap 8 provides a decorative and protective covering on the top of each of the panels 5. Similarly, post cap 9 covers and protects the top of each post 1.

The collars 3 are held on the posts 1 by bolts 10 having nuts 11. When the nuts 11 are loose the collars can be rotated on the posts to the desired orientations for the rails, and can be adjusted to the desired elevations on the posts, and then the nuts 11 can be tightened to fix the collars to the posts.

In order that the ends of two rails joined to a common post may be at the same level, two circular collars 3 are placed one above the other as shown in FIG. 4, and two sets of holes are provided at both sides of each rail. These holes are designated as upper holes 12 and lower holes 13 and the upper collar is connected to a rail at upper holes 12 and the lower collar at lower holes 13. If the ground on one side of a post has a different slope from that on the other side, the rails can be adjusted to suit the different slopes. In FIG. 4, rail 2′ is shown inclined. Collar 3 has an elongated slot 3*a* in which screw 4 serves as a pivot pin. Before the screws 4 are tightened, the rail 2′ is swung to the proper slope to suit the contour of the ground, and then the screws are tightened to resist movement of the rails relative to the collars.

The screws 4 thread into clamps 6′ nested within the rails as shown in FIG. 4. This arrangement can be seen also in FIG. 5, which is a sectional view along line 5—5 in FIG. 4. To secure one collar 3 to a rail 2, two screws 4 and two clamps 6′ are used. The clamps 6′ are identical to the clamps 6 described above, used for securing the panels 5 to the rails 2. As the screws 4 do not deform the rails 2 or the collars 3 in any way, the inclination of the fence can be changed at any time without the need for drilling new holes, simply by loosening the screws 4.

The fence is preferably made entirely of metal, so that it will not deteriorate, but the panels may be of plastic or wood and can be in any decorative shape or size and can be painted or given a permanent baked-on finish. As the panels are attached to the rails by clamps 6, the spacing between panels can be changed simply by loosening the clamps. The clamps 6 are narrower than the panels 2 and thus panels can be arranged in edge to edge contact with one another, as shown in FIG. 6, to provide greater privacy, or the panels at one side of the fence can overlap those at the other side, as shown in FIG. 7, providing good privacy as well as a wind break. The posts, rails and panels can be sturdy and free of warpage. Any part of the fence that becomes damaged can easily be replaced. No special tools are required to erect or dismantle the components.

Modifications to the preferred embodiment will readily occur to those skilled in the art and are intended to be covered by the following claims.

What I claim as my invention is:

1. A fence comprising longitudinal rails defining continuous longitudinally extending channels, panels that can be erected vertically, parallel to one another and transversely to the rails, and clamps for affixing the panels to the rails, the clamps being slidably engageable in the channels of the rails for adjustment of positions of the panels therealong, the clamps being of narrower width than the panels so that if desired the panels can be arranged in edge to edge contact with one another, and releasable means for securing the clamps in fixed relationship with the panels and the rails.

2. A fence as claimed in claim 1, wherein the channels are defined in the underside of the rails and the clamps can extend upwardly into said channels from either side thereof to affix panels at either side thereof.

3. A fence as claimed in claim 2, wherein the channels have inturned lips embraceable by the clamps to effect said slidable engagement of the clamps with the rails.

4. A fence as claimed in claim 3, wherein the clamps comprise resilient members, and the means for securing the clamps are screws passing through the panels which can tighten the clamps against the rails.

5. A fence as claimed in claim 4, wherein the panels comprise resilient metal pans having edges that can bear against the rails and central portions through which said screws can pass to pull the resilient clamps and pans together against the rails.

6. A fence as claimed in claim 5, wherein the panels have caps at their upper ends.

7. A fence as claimed in claim 2, including cylindrical posts, and means for adjusting the rails both vertically and rotationally about the posts, said means comprising collars that can encircle the posts and are securable to the rails.

8. A fence as claimed in claim 7, wherein the collars are pivotally securable to the rails.

9. A fence as claimed in claim 8, wherein the collars are securable to the rails by pin-in-slot connections, the pins being tightenable to resist movement of the rails relative to the collars.

10. A fence as claimed in claim 9, including means for tightening the collars on the posts.

* * * * *